US010352577B2

(12) United States Patent
Su et al.

(10) Patent No.: US 10,352,577 B2
(45) Date of Patent: Jul. 16, 2019

(54) WATER CONTROLLER AND WATER CONTROLLING METHOD

(71) Applicants: Xiaomi Inc., Beijing (CN); Beijing Smartmi Technology Co., Ltd., Beijing OT (CN)

(72) Inventors: Jun Su, Beijing (CN); Yi Wang, Beijing (CN); Yuya Omoto, Beijing (CN); Tie Liu, Beijing (CN)

(73) Assignees: XIAOMI INC., Beijing (CN); BEIJING SMARTMI TECHNOLOGY CO., LTD., Beijing (CN)

( * ) Notice: Subject to any disclaimer, the term of this patent is extended or adjusted under 35 U.S.C. 154(b) by 221 days.

(21) Appl. No.: 15/336,825

(22) Filed: Oct. 28, 2016

(65) Prior Publication Data

US 2017/0122581 A1 May 4, 2017

(30) Foreign Application Priority Data

Oct. 28, 2015 (CN) ..... 2015 1 0711798

(51) Int. Cl.
*F24F 6/02* (2006.01)
*F24F 11/00* (2018.01)
(Continued)

(52) U.S. Cl.
CPC ..... *F24F 6/025* (2013.01); *B67D 7/06* (2013.01); *F22B 1/284* (2013.01); *F24F 11/0008* (2013.01); *F24F 2006/008* (2013.01)

(58) Field of Classification Search
CPC ..... F24F 6/025; F24F 2006/008; B67D 7/06; F22B 1/284
(Continued)

(56) References Cited

U.S. PATENT DOCUMENTS 3,754,463 A * 8/1973 Vernooy ..... A47J 31/057 99/295
3,998,425 A * 12/1976 Braucksiek ..... H01F 7/06 251/129.16
(Continued)

FOREIGN PATENT DOCUMENTS

CN 2350698 Y 11/1999
CN 202149560 U 2/2012
(Continued)

OTHER PUBLICATIONS

The Non-final Office Action on Russian patent application No. 2016132973/12(051050), dated Aug. 13, 2018.
(Continued)

*Primary Examiner* — Jimmy Chou
(74) *Attorney, Agent, or Firm* — Jun He Law Offices P.C.; James J. Zhu

(57) ABSTRACT

A water controller and a water controlling method are provided. The water controller includes: a water tank having a first water outlet; a magnetic control assembly; a water trough having a water inlet, the first water outlet being connected with the water inlet via the magnetic control assembly; an electromagnet configured to switch between a power-on state and a power-off state; wherein when the electromagnet is in a power-on state, a path between the first water outlet and the water inlet is in a connected state under control of the control assembly; and when the electromagnet is in a power-off state, the path between the first water outlet and the water inlet is in a blocking state under the control of the control assembly.

10 Claims, 4 Drawing Sheets

(51) Int. Cl.
*B67D 7/06* (2010.01)
*F22B 1/28* (2006.01)
*F24F 6/00* (2006.01)

(58) Field of Classification Search
USPC ..... 219/628; 99/280, 282; 251/129.15
See application file for complete search history.

(56) References Cited

U.S. PATENT DOCUMENTS 4,089,915 A 5/1978 Jackson
4,270,726 A * 6/1981 Hertfelder ..... B60H 1/00485 251/30.03
4,714,234 A * 12/1987 Falk ..... A61M 5/14216 137/375
4,978,058 A * 12/1990 Duncan ..... D06F 39/088 236/12.12
5,375,508 A * 12/1994 Knepler ..... A47J 31/0576 219/483
5,996,965 A * 12/1999 Eichholz ..... F16K 31/402 251/129.17
6,526,872 B2 * 3/2003 Wong ..... A47J 31/053 99/282
6,729,277 B2 * 5/2004 Yamaki ..... F01L 9/04 123/90.11
7,021,278 B2 * 4/2006 Ishizuka ..... F02D 41/1401 123/299
8,050,417 B2 * 11/2011 Lasa ..... F16K 31/402 251/129.15
2003/0041604 A1 3/2003 Jang
2003/0178591 A1 * 9/2003 Hwang ..... F16K 31/3855 251/26
2003/0230567 A1 * 12/2003 Centanni ..... A61L 2/07 219/628
2005/0072776 A1 * 4/2005 Doh ..... B64D 13/00 219/682
2005/0109610 A1 * 5/2005 Inamoto ..... C02F 1/4618 204/229.5
2006/0086328 A1 * 4/2006 Hedman ..... F01L 9/02 123/90.12
2008/0179556 A1 * 7/2008 Lasa ..... F16K 31/402 251/129.21
2009/0224191 A1 * 9/2009 Nam ..... F16K 31/404 251/129.15
2011/0095010 A1 * 4/2011 Bondarowicz ..... F24H 1/202 219/209
2012/0222548 A1 9/2012 Lev et al.
2012/0328748 A1 * 12/2012 Doglioni Majer .... A47J 31/465 426/231
2013/0032740 A1 * 2/2013 Ro ..... F16K 31/404 251/129.15
2014/0070031 A1 * 3/2014 Lowry ..... F01N 3/2066 239/585.1
2015/0135562 A1 * 5/2015 Rosa ..... D06F 75/02 38/77.6
2016/0131403 A1 * 5/2016 Andoh ..... F16K 27/029 62/160
2018/0254133 A1 * 9/2018 Wang ..... F01L 1/3442

FOREIGN PATENT DOCUMENTS

CN 102903569 A 1/2013
CN 203274111 U 11/2013
CN 103512129 A * 1/2014
CN 103512129 A 1/2014
CN 203550097 U 4/2014
CN 105352114 A 2/2016
CN 205332458 U 6/2016
EP 1929905 A1 6/2008
JP S4982548 U1 7/1974
JP S55122574 U1 8/1980
JP S55140875 U1 10/1980
JP H49475 U 1/1992
JP H05164408 6/1993
JP 2008039382 A 2/2008
JP 5164408 B2 3/2013
KR 20070017789 A 2/2007

OTHER PUBLICATIONS

International Search Report of PCT/CN2016/084957.
Extended European Search Report for European application No. 16194472.3, dated May 9, 2017.
International Search Report for International application No. PCT/CN2016/084957, dated Sep. 14, 2016.
First Office Action for EP application No. 16194472.3, dated Feb. 28, 2019.

* cited by examiner

WATER CONTROLLER AND WATER CONTROLLING METHOD

CROSS-REFERENCE TO RELATED APPLICATIONS

This application is based upon and claims priority to Chinese Patent Application 201510711798.5, filed Oct. 28, 2015, the entire contents of which are incorporated herein by reference.

TECHNICAL FIELD

The present disclosure generally relates to field of water controlling, and more particularly, to a water controller and a water controlling method.

BACKGROUND

With improvement of people's quality of life, more and more users utilize humidifiers for moisturizing. Generally, the humidifier is provided with a water tank, a water trough, a buoy, and an atomizing sheet. When a water level in the water trough reaches a predefined height, the buoy controls a component to block a water inlet between the water tank and the water trough. When the water level in the water trough does not reach the predefined height, the buoy controls the component to open the water inlet between the water tank and the water trough, thereby water in the water tank flows into the water trough. The atomizing sheet is used for atomizing the water in the water trough and discharging the atomized water.

SUMMARY

According to a first aspect of embodiments of the present disclosure, there is provided a water controller, including: a water tank having a first water outlet; a magnetic control assembly; a water trough having a water inlet, the first water outlet being connected with the water inlet via the magnetic control assembly; an electromagnet configured to switch between a power-on state and a power-off state; and wherein when the electromagnet is in a power-on state, a path between the first water outlet and the water inlet is in a connected state under control of the control assembly; and when the electromagnet is in a power-off state, the path between the first water outlet and the water inlet is in a blocking state under the control of the control assembly.

According to a second aspect of embodiments of the present disclosure, there is provided a water controlling method, which is applied in any water controller according to the first aspect, including: detecting whether a water level in the water trough satisfies an inflow condition; when the water level satisfies the inflow condition, controlling the electromagnet to be in the power-on state and triggering the control assembly by the electromagnet in the power-on state to control the path between the first water outlet and the water inlet to be in the connected state, such that water in the water tank flows from the first water outlet to the water inlet; and when the water level does not satisfy the inflow condition, controlling the electromagnet to be in the power-off state and controlling the path between the first water outlet and the water inlet to be in the blocking state by the control assembly, such that water in the water tank does not flow from the first water outlet to the water inlet.

According to a third aspect of embodiments of the present disclosure, there is provided a water controlling device, including: any water controller according to the first aspect; a processor; and a memory for storing instructions executable by the processor; wherein the processor is configured to: detect whether a water level in the water trough satisfies an inflow condition; when the water level satisfies the inflow condition, control the electromagnet to be in the power-on state and trigger the control assembly by the electromagnet in the power-on state to control the path between the first water outlet and the water inlet to be in the connected state, such that water in the water tank flows from the first water outlet to the water inlet; and when the water level does not satisfy the inflow condition, control the electromagnet to be in the power-off state and trigger the control assembly via the electromagnet in the power-off state to control the path between the first water outlet and the water inlet to be in the blocking state, such that water in the water tank does not flow from the first water outlet to the water inlet.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate embodiments consistent with the invention and, together with the description, serve to explain the principles of the invention.

DETAILED DESCRIPTION

Reference will now be made in detail to exemplary embodiments, examples of which are illustrated in the accompanying drawings. The following description refers to the accompanying drawings in which the same numbers in different drawings represent the same or similar elements unless otherwise represented. The implementations set forth in the following description of exemplary embodiments do not represent all implementations consistent with the invention. Instead, they are merely examples of apparatuses and methods consistent with aspects related to the invention as recited in the appended claims.

Figure 1:
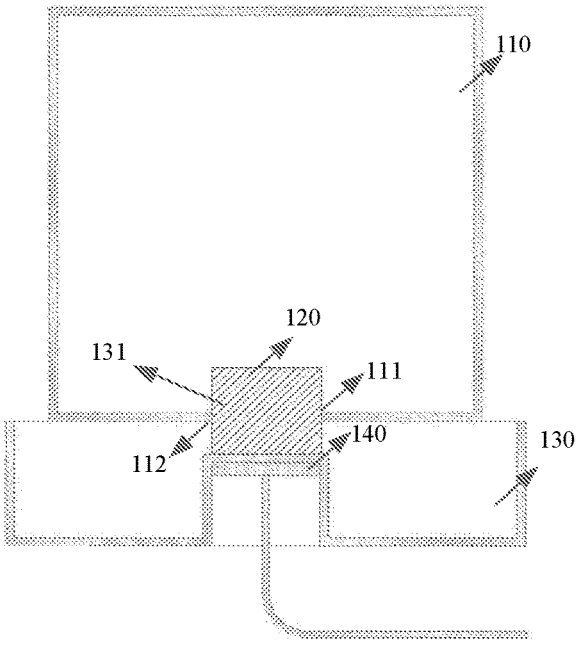
FIG. 1 is a schematic diagram illustrating a water controller according to an exemplary embodiment.

FIG. 1 is a schematic diagram illustrating a water controller according to an exemplary embodiment. As shown in FIG. 1, the water controller includes: a water tank 110, a magnetic control assembly 120, a water trough 130, and an electromagnet 140. The water tank 110 includes a first water outlet 111, and the water trough 130 includes a water inlet 131. The first water outlet 111 is connected with a water inlet 131 via the control assembly 120.

When the electromagnet 140 is in a power-on state, a path between the first water outlet 111 and the water inlet 131 is in a connected state under control of the control assembly 120.

When the electromagnet 140 is in a power-off state, the path between the first water outlet 111 and the water inlet 131 is in a blocking state under the control of the control assembly 120.

Typically, when the component at which the buoy is located is used to control the water in the water tank to flow to the water trough, a shaft of the lever in the assembly is easy to be damaged. With the water controller provided by the present disclosure, when the electromagnet is in the power-on state, the path between the first water outlet and the water inlet is in the connected state under the control of the control assembly, and when the electromagnet is in the power-off state, the path between the first water outlet and the water inlet is in the blocking state under the control of the control assembly. In this way, the electromagnet is utilized to attract or repel the control assembly to open or close the water path, thus prolonging the usage life of the water controller.

The water tank 110 is used for providing water to the water trough 130, and the water tank 110 includes the first water outlet 111 and a water tank inlet (not shown in the drawing). The water flows into the water tank 110 via the water tank inlet, and then flows out of the water tank 110 via the first water outlet 111. In the present embodiment, the first water outlet 111 may be provided below the water tank 110, such that the water may flow out under the gravity without a water pumping device for the water tank 110. In this way, resources may be saved, and the structure of the water controller may be simplified. In the present embodiment, the shape and the size of the water tank 110 are not limited.

The water trough 130 includes a water inlet 131, and the water flows into the water trough 130 via the water inlet 131. In the present embodiment, the water in the water tank 110 is controlled to flow into the water trough 130, and the first water outlet 111 in the water tank 110 is provided below the water tank 110, thus it is proper to provide the water trough 130 below the water tank 110. That is, the water inlet 131 is provided above the water trough 130, and the first water outlet 111 is faced to the water inlet 131. At this time, the water in the water tank 110 flows to the water trough 130 via the first water outlet 111 and the water inlet 131. In the present embodiment, the shape and the size of the water trough 130 are not limited.

In order to control the water, it is also possible to provide a magnetic control assembly 120 between the water tank 110 and the water trough 130, and control the control assembly 120 via an electromagnet 140. For example, when the electromagnet 140 is in a power-on state, a path between the first water outlet 111 and the water inlet 131 is in a connected state under control of the control assembly 120; and when the electromagnet 140 is in a power-off state, the path between the first water outlet 111 and the water inlet 131 is in a blocking state under the control of the control assembly 120. In the present embodiment, position relationships between the electromagnet 140 and the water trough 130 are not limited.

Figure 2A:
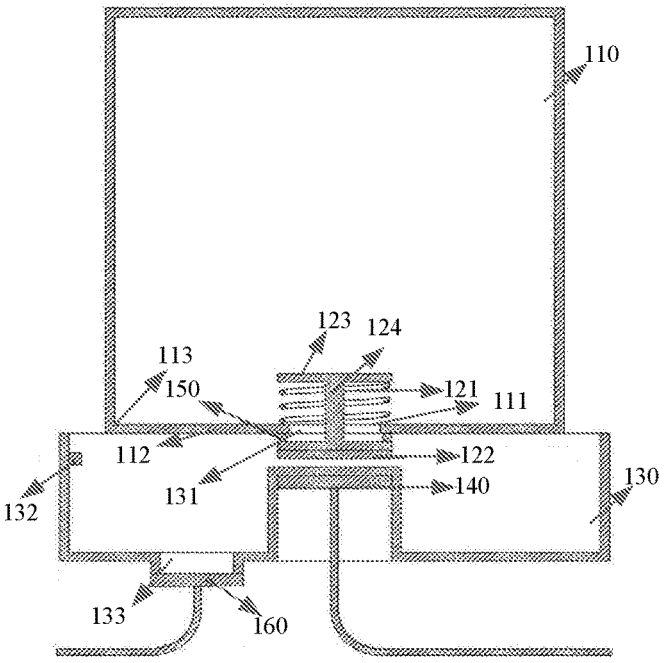
FIG. 2A is a schematic diagram illustrating an example structure of the water controller according to an exemplary embodiment.

With reference to FIG. 2A, which illustrates a schematic diagram of a first structure of the water controller. The control assembly 120 includes a spring 121, a first magnetic component 122, a second component 123 located above the first magnetic component 122 and paralleled with the first magnetic component 122, and a connecting component 124 positioned between the first magnetic component 122 and the second component 123, and the spring 121 is sleeved on the connecting component 124.

In the present embodiment, the first magnetic component 122, the second component 123 and the connecting component 124 form a component having a shape of "U". When the above three components are made of soft materials such as rubber, the first magnetic component 122, the second component 123 and the connecting component 124 may be an integral whole, and after squeezing the first magnetic component 122 or the second component 123, the spring 121 is sleeved on the connecting component 124. When the above three components are made of hard materials such as plastic, the first magnetic component 122 and the connecting component 124 may be an integral whole, and after the spring 121 is sleeved on the connecting component 124, the second component 123 is connected to the connecting component 124. Alternatively, the second component 123 and the connecting component 124 may be an integral whole, and after the spring 121 is sleeved on the connecting component 124, the first magnetic component 122 is connected to the connecting component 124. A diameter of the spring 121 is smaller than those of the first magnetic component 122 and the second component 123.

More details about the control assembly 120 and the water tank 110 will be described below.

In some embodiments, the first magnetic component 122 is positioned under the first water outlet 111 to cover the first water outlet 111 and closely contact with an outer wall 112 of the water tank 110, and the spring 121 is located between an inner wall 113 of the water tank 110 and the second component 123, and the spring 121 is in a compression state.

The first magnetic component 122 is a magnet or an iron. Alternatively, a lower surface of the first magnetic component 122 is provided with a magnet or an iron. The magnetism of the magnet is opposite to that of the electromagnet 140 in the power-on state.

When the electromagnet 140 is in the power-off state, the electromagnet 140 does not generate a magnetic force. Since the spring 121 is located between the inner wall 113 of the water tank 110 and the second component 123, and the spring 121 is in the compression state, the spring 121 will generate an elastic force upward to the second component 123, and the second component 123 will generate an tensile force upward to the first magnetic component 122 via the connecting component 124, such that the first magnetic component 122 is closely contacted with the outer wall 112 of the water tank 110. At this time, the water in the water tank 110 is blocked by the first magnetic component 122 and cannot flow to the water trough 130. That is, the control assembly 120 controls the path between the first water outlet 111 and the water inlet 131 to be in the blocking state.

Figure 2B:
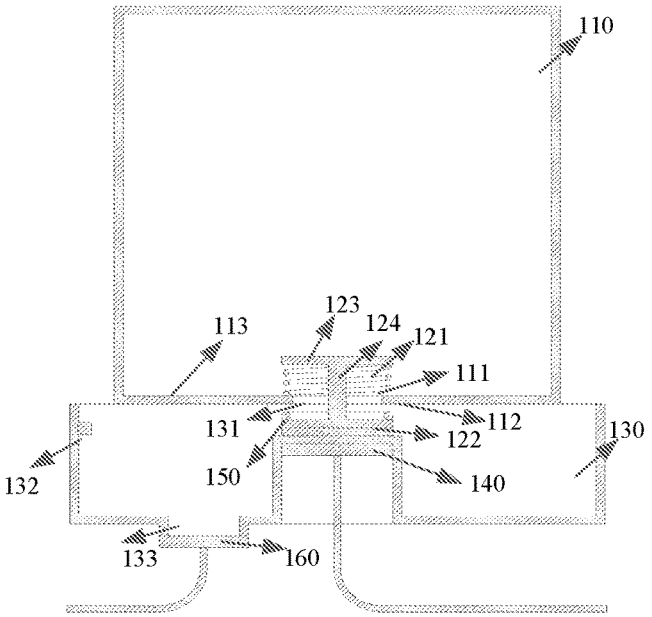
FIG. 2B is a schematic diagram illustrating an example operation of the water controller according to an exemplary embodiment.

When the electromagnet 140 is in the power-on state, the electromagnet 140 generates a magnetic force. At this time, the electromagnet 140 will generate an attraction force downward to the first magnetic component 122. When the attraction force is larger than the elastic force of the spring 121, the control assembly 120 moves downwardly. At this time, the first magnetic component 122 is no longer closely contacted with the outer wall 112 of the water tank 110, and a gap will be formed therebetween, thus the water in the water tank 110 flows to the water trough 130 via the gap. That is, the control assembly 120 controls the path between the first water outlet 111 and the water inlet 131 to be in the connected state. FIG. 2B illustrates a schematic diagram of an example operation of the water controller.

Additionally, in order to improve sealing between the first magnetic component 122 and the outer wall 112 of the water tank 110, it is also possible to provide a seal ring 150 between the first magnetic component 122 and the outer wall 112 of the water tank 110.

Figure 2C:
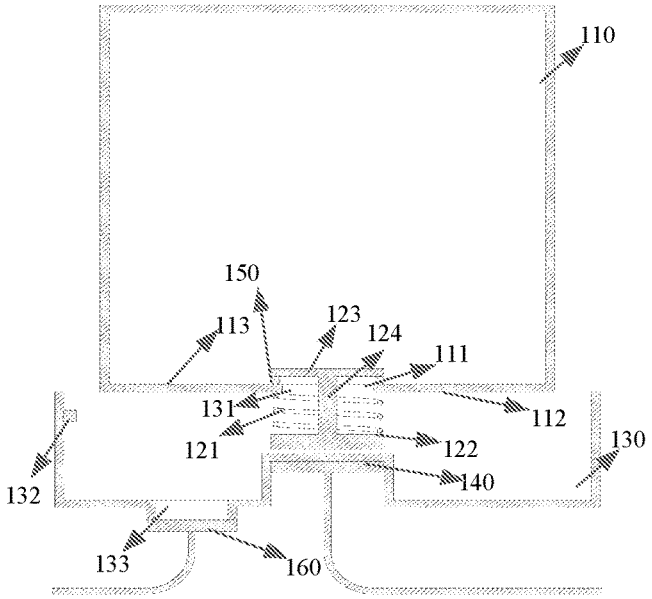
FIG. 2C is a schematic diagram illustrating another example structure of the water controller according to an exemplary embodiment.

In some embodiments, with reference to FIG. 2C which illustrates a schematic diagram of another example structure of the water controller, the second component 123 is positioned above the first water outlet 111 to cover the first water outlet 111 and closely contact with an inner wall 113 of the water tank 110, the spring 121 is located between the outer wall 112 of the water tank 110 and the first magnetic component 122, and the spring 121 is in a compression state.

The first magnetic component 122 is a magnet. Alternatively, a lower surface of the first magnetic component 122 is provided with a magnet. The magnetism of the magnet is the same as that of the electromagnet 140 in the power-on state.

When the electromagnet 140 is in the power-off state, the electromagnet 140 does not generate a magnetic force. Since the spring 121 is located between the outer wall 112 of the water tank 110 and the first magnetic component 122, and the spring 121 is in the compression state. The spring 121 will generate an elastic force downward to the first magnetic component 122, and the first magnetic component 122 will generate a tensile force downward to the second component 123 via the connecting component 124, such that the second component 123 is closely contacted with the inner wall 113 of the water tank 110. At this time, the water in the water tank 110 is blocked by the second component 123 and cannot flow to the water trough 130. That is, the control assembly 120 controls the path between the first water outlet 111 and the water inlet 131 to be in the blocking state.

Figure 2D:
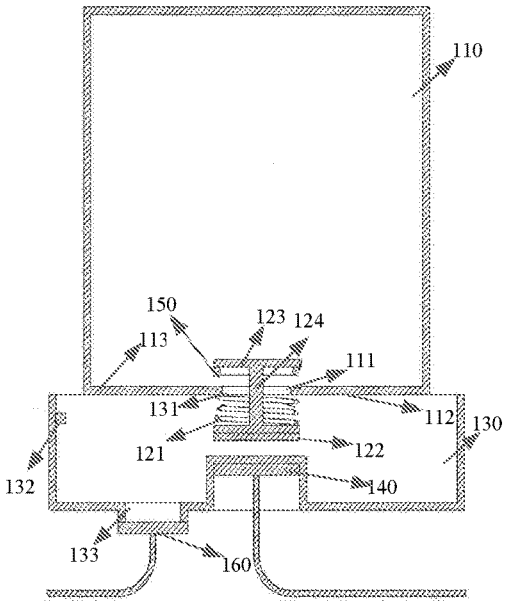
FIG. 2D is a schematic diagram illustrating another example operation of the water controller according to an exemplary embodiment.

When the electromagnet 140 is in the power-on state, the electromagnet 140 generates a magnetic force. At this time, the electromagnet 140 will generate a repelling force upward to the first magnetic component 122. When the repelling force is larger than the elastic force of the spring 121, the control assembly 120 moves upwardly. At this time, the second component 123 is no longer closely contacted with the inner wall 113 of the water tank 110, and a gap will be formed therebetween, thus the water in the water tank 110 flows to the water trough 130 via the gap. That is, the control assembly 120 controls the path between the first water outlet 111 and the water inlet 131 to be in the connected state. FIG. 2D illustrates a schematic diagram of another example operation of the water controller.

Additionally, in order to improve sealing between the second component 123 and the inner wall 113 of the water tank 110, it is also possible to provide a seal ring 150 between the second component 123 and the inner wall 113 of the water tank 110.

It should be further explained that in order to precisely control water volume in the water trough 130, at least one water level sensor 132 is provided in the water trough 130. The water level sensor 132 is used for controlling the electromagnet 140 to be in the power-on state or the power-off state.

When one water level sensor 132 is provided in the water trough 130, it is possible to control the electromagnet 140 to be in the power-on state and discharge water into the water trough 130 when sensing that the water level is lower than a predefined height by the water level sensor 132. The water level sensor 132 can also control the electromagnet 140 to be in the power-off state and does not discharge water into the water trough 130 when the water level is higher than the predefined height.

When at least two water level sensors 132 are provided in the water trough 130, it is possible to utilize one water level sensor 132 as a high water level sensor, and utilize the other water level sensor 132 as a low water level sensor. In this case, when sensing by the lower water level sensor that the water level is lower than a first height, the electromagnet 140 is controlled to be in the power-on state and water is discharged to the water trough 130. When sensing by the high water level sensor that the water level is higher than a second height, the electromagnet 140 is controlled to be in the power-off state and water is not discharged to the water trough 130. Thus, the water level in the water trough 130 can be precisely controlled. The second height is higher than the first height.

When the water controller provided by the present embodiment is applied to a humidifier, the water controller further includes an atomizing sheet 160. The atomizing sheet 160 is connected to a second water outlet 133 of the water trough 130 and is used for atomizing water in the water trough 130 and discharging the atomized water. Details about atomizing sheet 160 would not be elaborated in the present embodiment.

In sum, with the water controller provided by the present disclosure, when the electromagnet is in the power-on state, the path between the first water outlet and the water inlet is in the connected state under the control of the control assembly. When the electromagnet is in the power-off state, the path between the first water outlet and the water inlet is in the blocking state under the control of the control assembly. In this way, the electromagnet is utilized to attract or repel the control assembly to open or close the water path, thus prolonging the usage life of the water controller.

In addition, the first water outlet is positioned below the water tank to make the water flow out under the gravity without additional water pumping device for the water tank, thus, the resources may be saved and the structure of the water controller may be simplified.

In addition, the magnetism of the first magnetic component may be the same as or opposite to that of the electromagnet in the power-on state, thereby providing various implementation manners of the water controller.

In addition, a seal ring is positioned between the first magnetic component and the outer wall of the water tank, thus, the sealing between the first magnetic component and the outer wall of the water tank may be improved. Alternatively, a seal ring is positioned between the second component and the inner wall of the water tank, thus, the sealing between the second component and the inner wall of the water tank may be improved.

Figure 3:
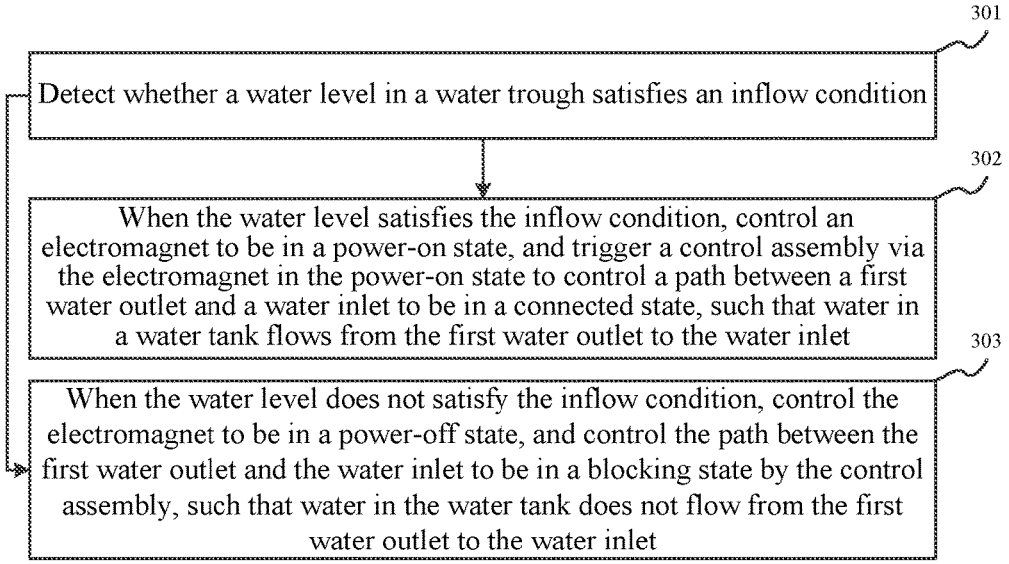
FIG. 3 is a flow chart illustrating a water controlling method according to an exemplary embodiment.

FIG. 3 is a flow chart illustrating a water controlling method according to an exemplary embodiment. The water controlling method is applied in the water controller shown in FIG. 1, FIG. 2A and FIG. 2B. As shown in FIG. 3, the water controlling method includes the following steps.

In step 301, it is detected whether a water level in the water trough satisfies an inflow condition.

In step 302, when the water level satisfies the inflow condition, the electromagnet is controlled to be in the power-on state, and the control assembly is triggered via the electromagnet in the power-on state to control the path between the first water outlet and the water inlet to be in the connected state, such that water in the water tank flows from the first water outlet to the water inlet.

In step 303, when the water level does not satisfy the inflow condition, the electromagnet is controlled to be in the power-off state, and the path between the first water outlet and the water inlet is controlled to be in the blocking state via the control assembly, such that water in the water tank does not flow from the first water outlet to the water inlet.

In sum, with the water controlling method provided by the present disclosure, when the water level satisfies the inflow condition, the electromagnet is controlled to be in the power-on state, and the control assembly is triggered via the electromagnet in the power-on state to control the path between the first water outlet and the water inlet to be in the connected state, such that water in the water tank flows from the first water outlet to the water inlet; and when the water level does not satisfy the inflow condition, the electromagnet is controlled to be in the power-off state, and the path between the first water outlet and the water inlet is controlled to be in the blocking state via the control assembly, such that water in the water tank does not flow from the first water outlet to the water inlet. In this way, the electromagnet is utilized to attract or repel the control assembly so as to open or close the water path, thus prolonging the usage life of the water controller.

Figure 4:
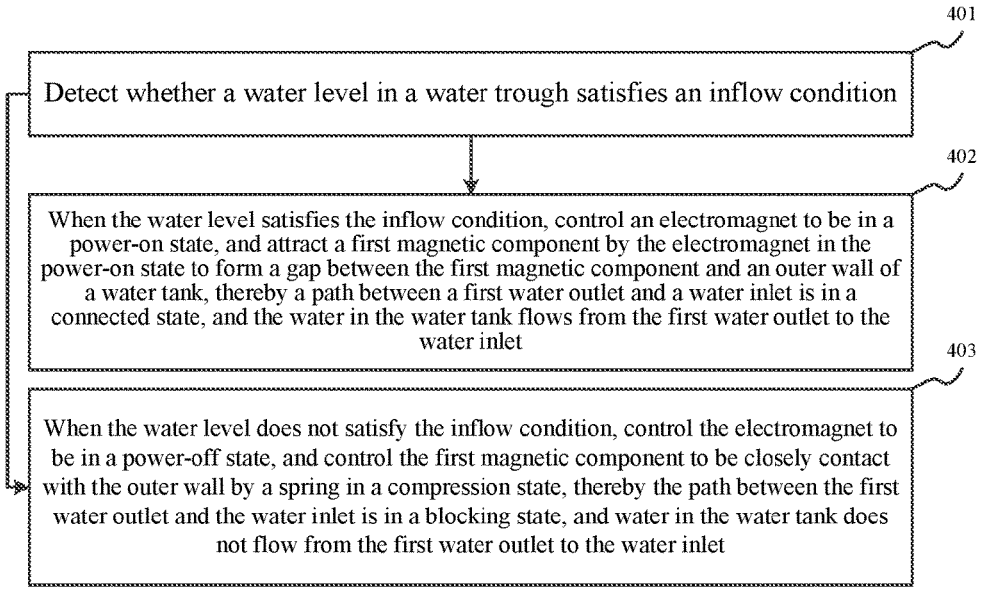
FIG. 4 is a flow chart illustrating a water controlling method according to another exemplary embodiment.

FIG. 4 is a flow chart illustrating a water controlling method according to another exemplary embodiment. The water controlling method is applied in the water controller shown in FIG. 1, FIG. 2A, FIG. 2B, FIG. 2C or FIG. 2D, and the magnetism of the magnet in the control assembly of the water controller is opposite to that of the electromagnet in the power-on state. As shown in FIG. 4, the water controlling method includes the following steps.

In step 401, it is detected whether a water level in the water trough satisfies an inflow condition.

The water controller may sense the water level of the water trough via the water level sensor provided in the water trough, and then detect whether the water level satisfies the inflow condition.

When one water level sensor is provided in the water trough, a predefined height may be set. When the water level in the water trough reaches the predefined height, it is determined that the water level does not satisfy the inflow condition. When the water level in the water trough does not reach the predefined height, it is determined that the water level satisfies the inflow condition.

When at least two water level sensors are provided in the water trough, a first height and a second height may be set. When the water level in the water trough is lower than the first height, it is determined that the water level satisfies the inflow condition. When the water level in the water trough is higher than the second height, it is determined that the water level does not satisfy the inflow condition, wherein the second height is higher than the first height.

In step 402, when the water level satisfies the inflow condition, the electromagnet is controlled to be in the power-on state, the first magnetic component is attracted via the electromagnet in the power-on state, then a gap is formed between the first magnetic component and the outer wall of the water tank, thereby the path between the first water outlet and the water inlet is in the connected state, and the water in the water tank flows from the first water outlet to the water inlet.

When the electromagnet is in the power-on state, the electromagnet generates a magnetic force. At this time, the electromagnet will generate an attraction force downward to the first magnetic component. When the attraction force is larger than the elastic force of the spring, the control assembly moves downwardly. At this time, the first magnetic component is not closely contacted with the outer wall of the water tank any more, and a gap will be formed therebetween, thus the water in the water tank flows to the water trough via the gap. That is, the control assembly controls the path between the first water outlet and the water inlet to be in the connected state. At this time, the water in the water tank flows from the first water outlet to the water inlet.

In step 403, when the water level does not satisfy the inflow condition, the electromagnet is controlled to be in the power-off state, and the first magnetic component is closely contacted with the outer wall under control of the spring in the compression state, thereby the path between the first water outlet and the water inlet is in the blocking state, and water in the water tank does not flow from the first water outlet to the water inlet.

When the electromagnet is in the power-off state, the electromagnet does not generate a magnetic force. Since the spring is located between the inner wall of the water tank and the second component and the spring is in the compression state, the spring will generate an elastic force upward to the second component, and the second component will generate a tensile force upward to the first magnetic component via the connecting component, such that the first magnetic component is closely contacted with the outer wall of the water tank. At this time, the water in the water tank is blocked by the first magnetic component and cannot flow to the water trough. That is, the control assembly controls the path between the first water outlet and the water inlet to be in the blocking state. At this time, water in the water tank does not flow from the first water outlet to the water inlet.

Additionally, when the water controller is applied into a humidifier, the water controller further includes an atomizing sheet, and the water controlling method further includes: atomizing water in the water trough and discharging the atomized water via the atomizing sheet.

In sum, with the water controlling method provided by the present disclosure, when the water level satisfies the inflow condition, the electromagnet is controlled to be in the power-on state, and the control assembly is triggered via the electromagnet in the power-on state to control the path between the first water outlet and the water inlet to be in the connected state, such that water in the water tank flows from the first water outlet to the water inlet; and when the water level does not satisfy the inflow condition, the electromagnet is controlled to be in the power-off state, and the path between the first water outlet and the water inlet is controlled to be in the blocking state via the control assembly, such that water in the water tank does not flow from the first water outlet to the water inlet. In this way, the electromagnet is utilized to attract or repel the control assembly so as to open or close the water path, thus prolonging the usage life of the water controller.

Figure 5:
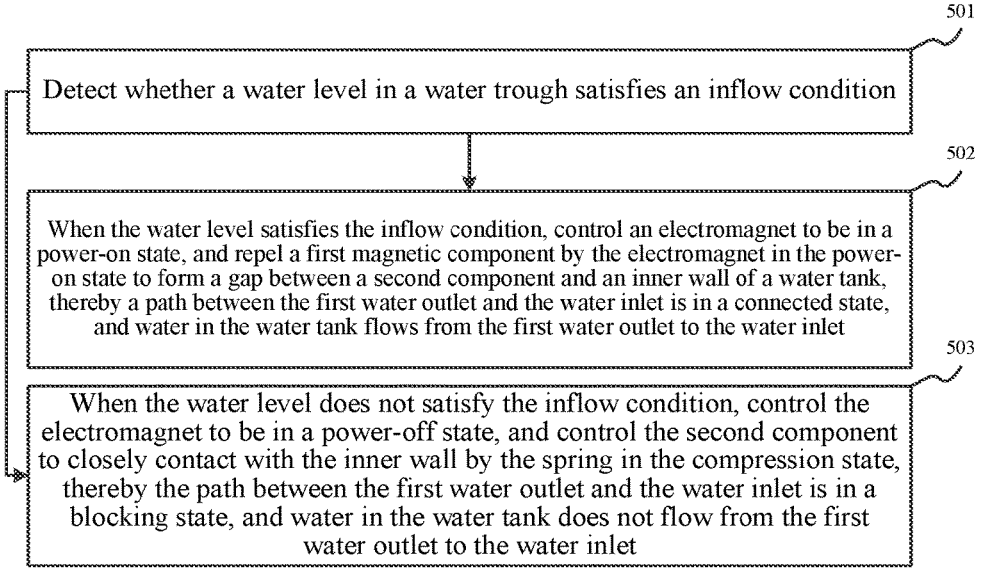
FIG. 5 is a flow chart illustrating a water controlling method according to further another exemplary embodiment.

FIG. 5 is a flow chart illustrating a water controlling method according to another exemplary embodiment. The water controlling method is applied in the water controller shown in FIG. 1, FIG. 2A, FIG. 2B, FIG. 2C or FIG. 2D, and the magnetism of the magnet in the control assembly of the water controller is the same as that of the electromagnet in the power-on state. As shown in FIG. 5, the water controlling method includes the following steps.

In step 501, it is detected whether a water level in the water trough satisfies an inflow condition.

Details of detecting whether a water level in the water trough satisfies an inflow condition via the water controller may be referred to the depiction in step 401, and is not elaborated herein.

In step 502, when the water level satisfies the inflow condition, the electromagnet is controlled to be in the power-on state, the first magnetic component is repelled by the electromagnet in the power-on state, and a gap is formed between the second component and the inner wall of the water tank. Thus, the path between the first water outlet and the water inlet is in the connected state, and the water in the water tank flows from the first water outlet to the water inlet.

When the electromagnet is in the power-on state, the electromagnet generates a magnetic force. At this time, the electromagnet will generate a repelling force upward to the first magnetic component, and when the repelling force is larger than the elastic force of the spring, the control assembly moves upwardly. At this time, the second component is no longer closely contacted with the inner wall of the water tank, and a gap will be formed therebetween, thus the water in the water tank flows to the water trough via the gap. That is, the control assembly controls the path between the first water outlet and the water inlet to be in the connected state. At this time, the water in the water tank flows from the first water outlet to the water inlet.

In step 503, when the water level does not satisfy the inflow condition, the electromagnet is controlled to be in the power-off state, and the second component is closely contacted with the inner wall under control of the spring in the compression state, thereby the path between the first water outlet and the water inlet is in the blocking state, and water in the water tank does not flow from the first water outlet to the water inlet.

When the electromagnet is in the power-off state, the electromagnet does not generate a magnetic force. Since the spring is located between the outer wall of the water tank and the first magnetic component, and the spring is in the compression state, the spring will generate an elastic force downward to the first magnetic component, and the first magnetic component will generate a tensile force downward to the second component via the connecting component, such that the second component is closely contacted with the inner wall of the water tank. At this time, the water in the water tank is blocked by the second component and cannot flow to the water trough. That is, the control assembly controls the path between the first water outlet and the water inlet to be in the blocking state. At this time, water in the water tank does not flow from the first water outlet to the water inlet.

Additionally, when the water controller is applied into a humidifier, the water controller further includes an atomizing sheet, and the water controlling method further includes: atomizing water in the water trough and discharging the atomized water via the component.

In sum, with the water controlling method provided by the present disclosure, when the water level satisfies the inflow condition, the electromagnet is controlled to be in the power-on state, and the control assembly is triggered by the electromagnet in the power-on state to control the path between the first water outlet and the water inlet to be in the connected state, such that water in the water tank flows from the first water outlet to the water inlet; and when the water level does not satisfy the inflow condition, the electromagnet is controlled to be in the power-off state, and the path between the first water outlet and the water inlet is controlled to be in the blocking state by the control assembly, such that water in the water tank does not flow from the first water outlet to the water inlet; in this way, the electromagnet is utilized to attract or repel the control assembly so as to open or close the water path, thus prolonging the usage life of the water controller.

The exemplary embodiment of the present disclosure provides a water controlling device, which can realize the water controlling method provided by the present disclosure. The water controlling device includes the water controller shown in FIG. 1, FIG. 2A, FIG. 2B, FIG. 2C or FIG. 2D; a processor; and a memory for storing instructions executable by the processor.

The processor is configured to: detect whether a water level in the water trough satisfies an inflow condition; when the water level satisfies the inflow condition, control the electromagnet to be in the power-on state, and trigger the control assembly via the electromagnet in the power-on state to control the path between the first water outlet and the water inlet to be in the connected state, such that water in the water tank flows from the first water outlet to the water inlet; and when the water level does not satisfy the inflow condition, control the electromagnet to be in the power-off state, and trigger the control assembly via the electromagnet in the power-off state to control the path between the first water outlet and the water inlet to be in the blocking state, such that water in the water tank does not flow from the first water outlet to the water inlet.

Other embodiments will be apparent to those skilled in the art from consideration of the specification and practice of the disclosure. This application is intended to cover any variations, uses, or adaptations of the invention following the general principles thereof and including such departures from the present disclosure as come within known or customary practice in the art. It is intended that the specification and examples be considered as exemplary only, with a true scope and spirit of the invention being indicated by the following claims.

It will be appreciated that the present invention is not limited to the exact construction that has been described above and illustrated in the accompanying drawings, and that various modifications and changes can be made without departing from the scope thereof. It is intended that the scope of the invention only be limited by the appended claims.

What is claimed is:

1. A water controller, comprising:

a water tank having a first water outlet;

a magnetic control assembly, wherein the magnetic control assembly comprises: a first magnetic component; a second component located above the first magnetic component and paralleled with the first magnetic component; and a connecting component positioned between the first magnetic component and the second component; and a spring sleeved on the connecting component;

a water trough having a water inlet, the first water outlet being connected with the water inlet via the magnetic control assembly;

an electromagnet configured to switch between a power-on state and a power-off state; and wherein when the electromagnet is in a power-on state, a path between the first water outlet and the water inlet is in a connected state under control of the control assembly; and when the electromagnet is in a power-off state, the path between the first water outlet and the water inlet is in a blocking state under the control of the control assembly.

2. The water controller of claim 1, wherein the water tank is located above the water trough, and the first water outlet is faced to the water inlet.

3. The water controller of claim 1, wherein the first magnetic component is a magnet or an iron.

4. The water controller of claim 1, wherein a lower surface of the first magnetic component is provided with a magnet or an iron.

5. The water controller of claim 1, wherein the first magnetic component is positioned under the first water outlet to cover the first water outlet and closely contact with an outer wall of the water tank, and the magnetism of the first magnetic component is opposite to that of the electromagnet in the power-on state; and the spring is located between an inner wall of the water tank and the second component and in a compression state.

6. The water controller of claim 5, wherein a seal ring is provided between the first magnetic component and the outer wall of the water tank.

7. The water controller of claim 1, wherein the second component is positioned above the first water outlet to cover the first water outlet and closely contact with an inner wall of the water tank, and the magnetism of the first magnetic component is the same as that of the electromagnet in the power-on state; and the spring is located between an outer wall of the water tank and the first magnetic component and in a compression state.

8. The water controller of claim 7, wherein a seal ring is provided between the second component and the inner wall of the water tank.

9. The water controller of claim 1, wherein the water trough comprises:

an atomizing sheet configured to atomize water and discharge the atomized water;

a second water outlet connected to the atomizing sheet.

10. A water controlling device, comprising:

the water controller of claim 1;

a processor; and a memory for storing instructions executable by the processor;

wherein the processor is configured to:

detect whether a water level in the water trough satisfies an inflow condition;

when the water level satisfies the inflow condition, control the electromagnet to be in the power-on state and trigger the control assembly by the electromagnet in the power-on state to control the path between the first water outlet and the water inlet to be in the connected state, such that water in the water tank flows from the first water outlet to the water inlet; and when the water level does not satisfy the inflow condition, control the electromagnet to be in the power-off state and trigger the control assembly via the electromagnet in the power-off state to control the path between the first water outlet and the water inlet to be in the blocking state, such that water in the water tank does not flow from the first water outlet to the water inlet.

* * * * *